US006302366B1

(12) United States Patent
Saylor et al.

(10) Patent No.: US 6,302,366 B1
(45) Date of Patent: Oct. 16, 2001

(54) GRIP CLIP

(75) Inventors: Charles Saylor, Grand Rapids, MI (US); Sheldon Phillips, Thousand Oaks; Edward Mitchell, Los Angeles, both of CA (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/304,166

(22) Filed: Apr. 30, 1999

(51) Int. Cl.[7] ..... A47B 97/04

(52) U.S. Cl. ..... 248/452; 248/229.25; 24/489; 24/501; 24/507

(58) Field of Search ..... 248/452, 450, 248/229.25, 231.71, 229.6, 304, 307, 316.2; 24/489, 510, 499, 500, 501, 502, 511, 507; D19/65, 86, 90; D8/395

(56) References Cited

U.S. PATENT DOCUMENTS

| | | | | |
|---|---|---|---|---|
| 121,303 | * | 11/1871 | Wattles | 24/501 |
| D. 298,711 | * | 11/1988 | Lowance | D6/547 |
| D. 302,568 | | 8/1989 | Berger . | |
| 333,489 | | 2/1993 | Stern et al. . | |
| D. 333,489 | | 2/1993 | Stern et al. . | |
| D. 350,985 | * | 9/1994 | Schmike | D19/65 |
| D. 364,188 | | 11/1995 | Wolff . | |

(List continued on next page.)

FOREIGN PATENT DOCUMENTS

WO97/46142 11/1997 (WO) .

OTHER PUBLICATIONS

Five pages from "Haworth Crossings™ Prices/Specification Guide", dated Nov., 1998 (5 pages).

*Primary Examiner*—Anita King
*Assistant Examiner*—Naschica Morrison
(74) *Attorney, Agent, or Firm*—Flynn, Thiel, Boutell & Tanis, P.C.

(57) ABSTRACT

An office accessory arrangement including a stationary support rail and a grip clip removably supported thereon. The grip clip includes a pair of opposed grip members joined to one another by a hinge arrangement for enabling relative pivoting of the grip members about a hinge axis. The grip clip has a biasing structure which relatively pivotably biases the grip members in opposite directions towards a closed position in which opposed inner gripping services of the respective grip members engage one another or engage a document therebetween. The support rail has a channel-like part which defines an outwardly opening narrow slot, with one side of the slot being defined by a cantilevered wall of the channel-like part. The grip clip, when engaged with the support rail, is disposed so that the cantilevered wall of the channel-like part projects into a slot defined within the support rail to securely position the grip clip thereon.

12 Claims, 5 Drawing Sheets

U.S. PATENT DOCUMENTS

| | | | | |
|---|---|---|---|---|
| D. 375,976 | | 11/1996 | Marguerie . | |
| D. 377,752 | * | 2/1997 | Gaudet | D8/373 |
| D. 392,181 | | 3/1998 | Bries et al. . | |
| D. 393,797 | * | 4/1998 | Kostigan | D8/395 |
| D. 393,878 | | 4/1998 | Suzuki . | |
| 401,533 | | 4/1889 | Godfrey . | |
| 401,553 | | 4/1889 | Godfrey . | |
| D. 406,168 | * | 2/1999 | Wolff | D19/65 |
| D. 412,343 | | 7/1999 | Offenhauer . | |
| D. 428,921 | * | 8/2000 | Saylor et al. | D19/65 |
| 1,039,554 | | 9/1912 | Lindhorst . | |
| 1,368,868 | * | 2/1921 | Wertman | 232/33 |
| 1,542,208 | * | 6/1925 | Berger | 24/507 |
| 2,209,697 | * | 7/1940 | Kislingbury et al. | 24/327 |
| 2,551,157 | | 5/1951 | Price . | |
| 3,947,138 | * | 3/1976 | Eshelman | 402/69 |
| 4,126,230 | | 11/1978 | Tyson et al. . | |
| 4,317,416 | | 3/1982 | Baum et al. . | |
| 4,323,291 | | 4/1982 | Ball . | |
| 4,506,416 | | 3/1985 | Ohminato et al. . | |
| 4,709,891 | | 12/1987 | Barnett . | |
| 4,852,500 | | 8/1989 | Ryburg et al. . | |
| 4,869,378 | * | 9/1989 | Miller | 211/94 |
| 4,879,955 | | 11/1989 | Moll et al. . | |
| 4,884,513 | | 12/1989 | Newhouse et al. . | |
| 4,899,971 | * | 2/1990 | Elkin | 248/225.1 |
| 4,938,442 | | 7/1990 | Mastrodicasa . | |
| 4,948,205 | | 8/1990 | Kelley . | |
| 4,959,892 | | 10/1990 | Wang . | |
| 4,974,913 | | 12/1990 | Vogt et al. . | |
| 4,993,785 | | 2/1991 | Dunand . | |
| 5,048,698 | | 9/1991 | Konrad . | |
| 5,057,039 | | 10/1991 | Persing et al. . | |
| 5,079,808 | | 1/1992 | Brown . | |
| 5,103,741 | | 4/1992 | Grund et al. . | |
| 5,121,698 | | 6/1992 | Kelley . | |
| 5,400,483 | | 3/1995 | Noda . | |
| 5,429,252 | | 7/1995 | Liu . | |
| 5,486,042 | | 1/1996 | Heisler et al. . | |
| 6,227,384 | * | 5/2001 | Saylor et al. | 211/50 |

* cited by examiner

GRIP CLIP

FIELD OF THE INVENTION

This invention relates to an improved grip clip which can be easily manually manipulated to permit gripping engagement with a document such as a paper and, more particularly, to an improved grip clip which can be cooperatively engaged with a stationary support rail and removably supported thereon to support and display a document.

BACKGROUND OF THE INVENTION

The modern office typically is overcrowded with equipment and documents, creating undesirable clutter and significant work inefficiencies.

In particular, most workers have numerous documents which are involved with work in progress, or are stored for ready accessibility or reference, and hence must often times be readily accessible and visible if possible. For this reason, many offices employ tackboards and other types of devices disposed adjacent and in surrounding relationship to worksurfaces so as to permit numerous papers and other documents to be clipped thereto, as by means of pins or tacks, so as to be readily visible and accessible. Such arrangements typically require that the office worker leave his chair so as to access the document, or typically involve wall-type constructions which surround the worksurface and thus greatly restrict overall openness and visibility at the worksurface.

Office workers also often utilize various types of spindles and miscellaneous types of clips, typically disposed in freestanding relationship on the top of the worksurface, to support documents or papers, and while such arrangements do permit the papers to be readily accessible, they nevertheless occupy significant space on the worksurface and thus greatly minimize the available space for efficient working.

It is an object of this invention to provide an improved arrangement which facilitates the gripping, display and accessibility of documents such as papers or the like, which minimizes or avoids utilization of valuable worksurface area, and which minimizes or eliminates surrounding structures which severely restrict openness or visibility adjacent the worksurface.

The present invention relates to an improved clip which can be easily gripped and manually manipulated in one hand so as to permit gripping of a document such as a paper between a pair of opposed gripping jaws. The clip can be used independently to permit gripping of one or more documents between the jaws, and includes mounting structure which readily permits the clip to be supportingly but removably engaged on a support rail, whereby the clip can be disposed to permit a document to be suspended upwardly from a worksurface in a region which does not significantly obstruct the worksurface, but yet provides physical and visual accessibility to the document. The support rail and clip have cooperating structures which permit the clip to be readily mounted on and slidably moved along the rail to permit selective positioning of the clip. The rail is stationarily mounted relative to the worksurface, such as adjacent and extending along a rear edge thereof in upwardly spaced relation so as to utilize space which is normally not otherwise efficiently used, and hence avoids interference with the top area of the worksurface.

The structural and functional advantages of the clip of this invention, as well as the desirable cooperative clip-and-rail arrangement of this invention, will be apparent upon the reading the following specification and inspecting the accompanying drawings.

Figure 1:
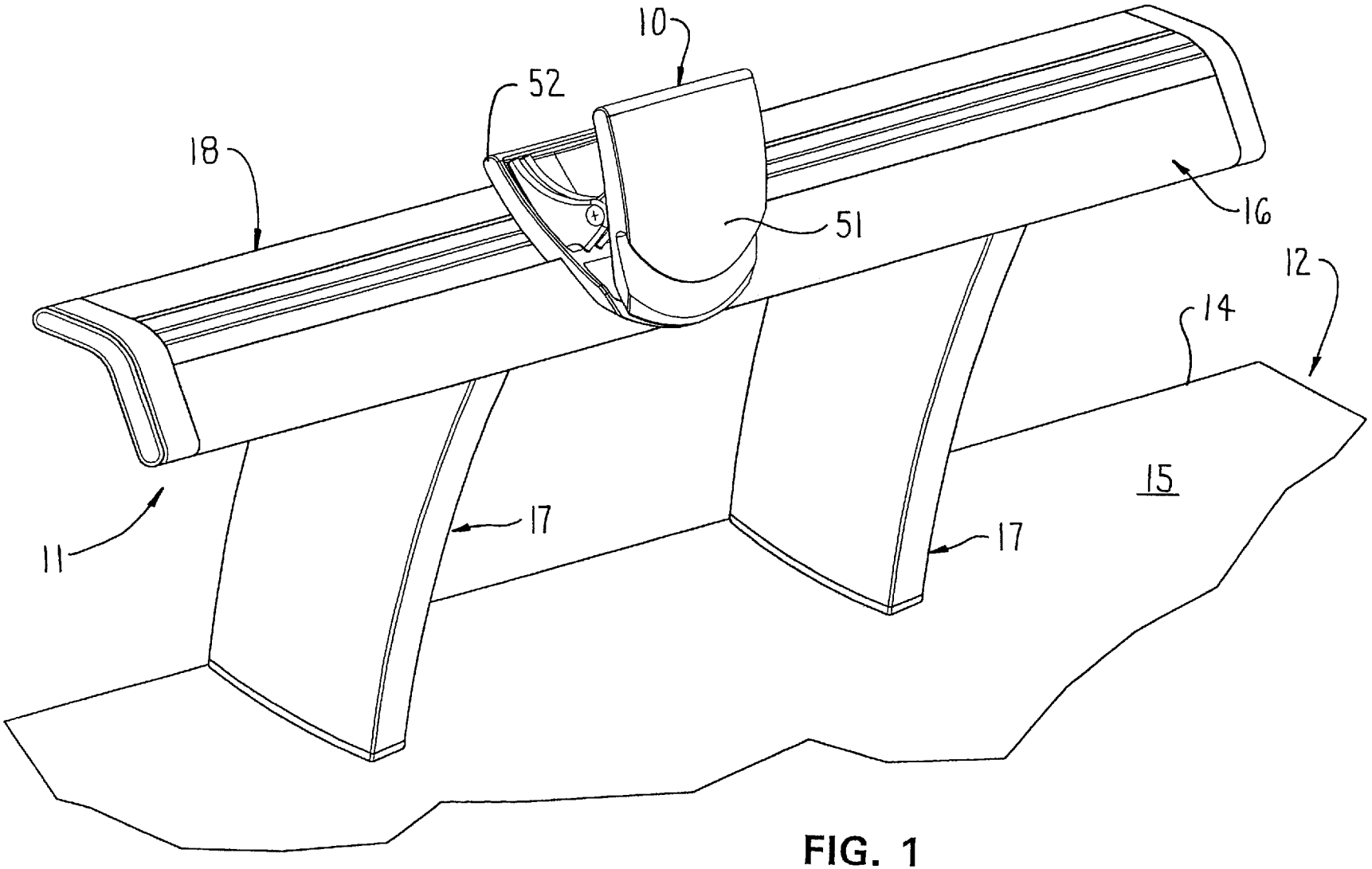
FIG. 1 is a perspective view of the rail and grip clip arrangement according to the present invention.

Certain terminology will be used in the following description for convenience in reference only, and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the clip or rail, and designated parts thereof. Said terminology will include the words specifically mentioned, derivatives thereof, and words of similar import.

DETAILED DESCRIPTION

Referring to FIG. 1, there is illustrated a grip clip 10 according to the present invention. This clip 10 in the illustrated embodiment is removably mounted on a support rail arrangement 11 which is positioned in close association with a worksurface 12.

Figure 2:
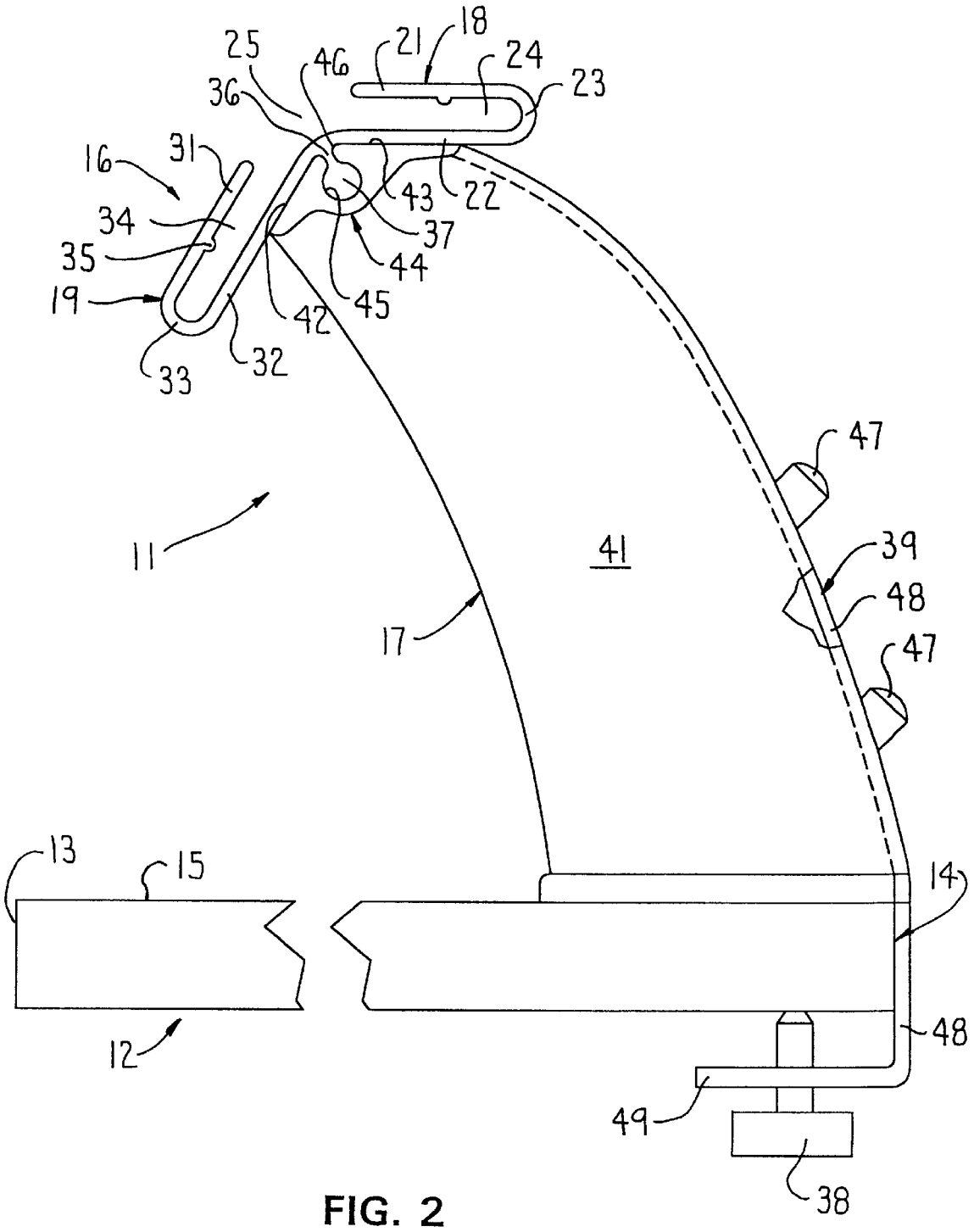
FIG. 2 is an end elevational view of the rail arrangement and illustrating attachment thereof to a worksurface.

The worksurface 12, as illustrated in FIG. 2, has respective front and rear longitudinally extending edges 13 and 14, and defines thereon an enlarged and substantially horizontal upper surface 15. The worksurface 12 can be provided with legs (not shown) so as to function as the top of a table, or can be mounted on support arms which project outwardly from a wall positioned adjacent the rear edge of the worksurface, both such constructions being conventional and well known.

The support rail arrangement 11 is intended for use in close association with the worksurface so as to provide additional mounting capability for office accessories or tools, such as the grip clip 10. The support rail arrangement 11 includes an elongate support rail 16 which is preferably disposed adjacent and extends lengthwise along an edge of the worksurface 12, such as the rear edge 14. The support rail 16 is, in the illustrated arrangement, secured to an upper end of at least one, and typically a pair of, support arms or stanchions 17 which in the illustrated embodiment are secured to the worksurface and project upwardly therefrom adjacent the rear edge 14 so as to support the elongate support rail 16 in raised relationship relative to the worksurface.

Considering first the elongate support rail 16, this rail is of a generally shallow and inverted V-shaped configuration in cross-section, and includes a rear leg 18 which is generally horizontal in the front-to-back direction of the worksurface. This rear leg 18 in turn is joined to a front leg 19 which, as it projects forwardly from its junction with the rear leg, is angled downwardly so that the legs 18 and 19 define a shallow V-like configuration.

The rear leg 18 is defined by generally parallel and horizontal top and bottom walls 21 and 22, respectively, the latter being joined by a curved edge wall 23 at the rearward edges thereof. The walls 21 and 22 are vertically spaced so as to define a narrow slot 24 therebetween. This slot 24 extends lengthwise throughout the horizontal length of the rail 16 and in addition opens horizontally forwardly so as to terminate at a mouth 25.

The front leg 19 of the support rail is of similar construction in that it is defined by spaced but substantially parallel top and bottom walls 31 and 32, respectively, which are joined at their front edges by a curved edge wall 33. These walls thus define a slot 34 therebetween which also extends lengthwise throughout the rail, and opens generally rearwardly through the mouth 25. The slot 34 preferably extends at an angle relative to both the horizontal and vertical, whereas the slot 24 preferably extends horizontally. The top wall 31, on the inner surface thereof, is preferably provided with a lengthwise-extending small detent rib 35 projecting downwardly therefrom in the vicinity of the closed end of the slot 34.

The support rail 16 also has a rib 36 extending lengthwise thereof along the undersurface of the rail substantially at the apex of the V as defined by the bottom walls 22 and 32. This rib 36 is of narrow width and projects outwardly only a limited extent, and at its outer end is joined to a lengthwise extending mounting rod 37 which is of increased cross-sectional size, and extends throughout substantially the length of the rail. The mounting rod 37 in the preferred embodiment is cylindrical in cross-section.

The support rail 16, in the illustrated embodiment, is supported in upwardly spaced relation along the rear edge of the worksurface by at least one, and quite typically two or more, support arms or stanchions 17. This support arm 17 includes a main body or tower part 41 which is supported on the upper surface of the worksurface 11 adjacent the rear edge 14 thereof, and is cantilevered upwardly. This main body part 41 at its upper end terminates in front and rear support surfaces 42 and 43, respectively, which are angled with respect to one another so as to substantially supportingly bear directly under the rail bottom walls 32 and 22, respectively. The body part 41 also has a sleeve part 44 affixed thereto and extending transversely in generally horizontal and parallel relationship with the lengthwise extent of support rail 16. This sleeve part 44 has a cylindrical opening 45 extending horizontally and transversely through the body part 41 adjacent the upper end thereof. A narrow slot 46 opens upwardly from the opening 45 between the support surfaces 42 and 43, and extends transversely across the upper end of the body part 41. The opening 45 and slot 46 enable the mounting rod 37 and rib 36, respectively, as associated with the support rail 16 to be slidably inserted therein so as to secure the rail 16 and body part 41 together.

To secure the body part 41 to the worksurface 12, the support arm 17 includes an L-shaped mounting part 39 which has a generally upwardly extending leg 48 which overlaps and is fixedly secured to the rear upright surface of the body part 41. This, in the illustrated embodiment, is accomplished by means of a pair of pins 47 which project from the rear of the body part 41 and which are engaged within slots or openings (not shown) formed in the upright leg 48 so as to permit fixed coupling of the leg 48 to the body part 41. This upright leg 48 is positioned so as to extend downwardly directly adjacent the worksurface rear edge 14 without protruding outwardly a significant extent, and the upright leg 48 at its lower end terminates in and is rigidly joined to a horizontally projecting forward leg 49, the latter being spaced downwardly from the bottom of the worksurface 12. This bottom horizontal leg 49 mounts on thereon a manually adjustable fastening member 38. The latter is preferably threadedly engaged with the horizontal leg 49 and at its lower end has an enlarged head or knob which can be manually gripped, or gripped by a tool, so as to enable the upper end of the fastening member 38 to move into clamping engagement with the bottom of the worksurface upon rotation of the fastening member so as to secure the body part 41 tightly against the upper surface of the worksurface.

The overall construction of the support rail arrangement 11, as summarized above, is described in detail in copending application Ser. No. 09/304162, filed concurrently herewith, entitled "Support Rail Assembly for Office Accessories", the disclosure of which in its entirety is incorporated herein by reference.

The construction of the grip clip 10 will now be described in detail.

Figure 3:
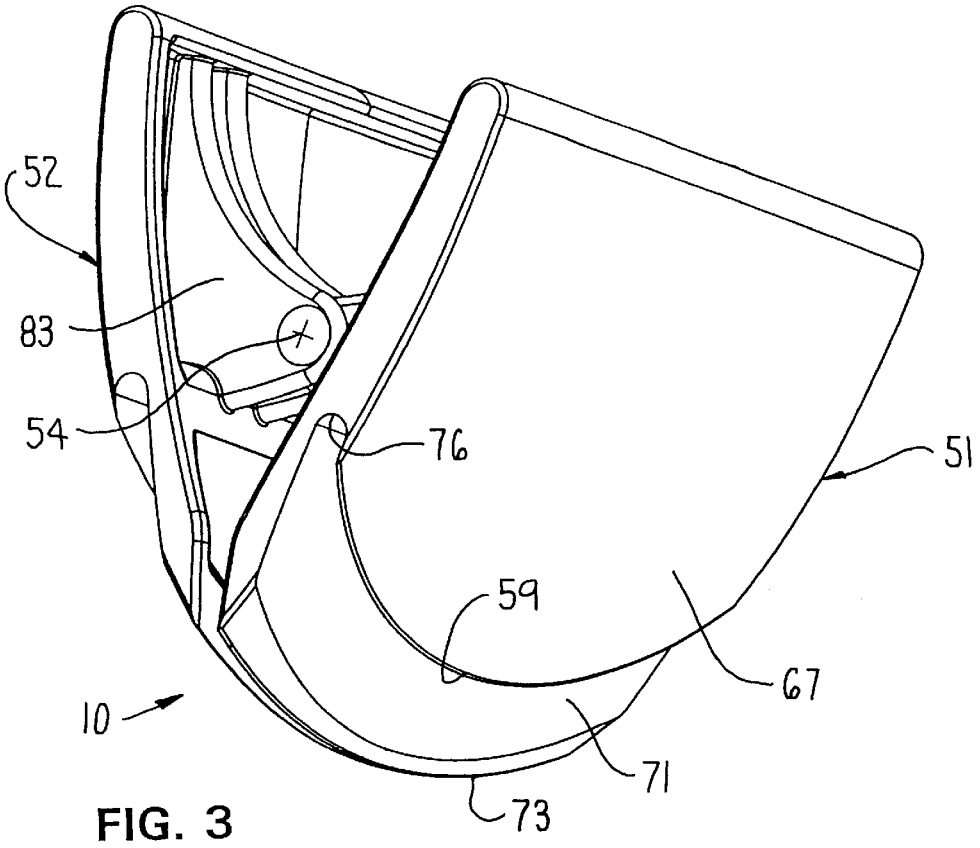
FIG. 3 is a perspective view of the grip clip.
Figure 4:
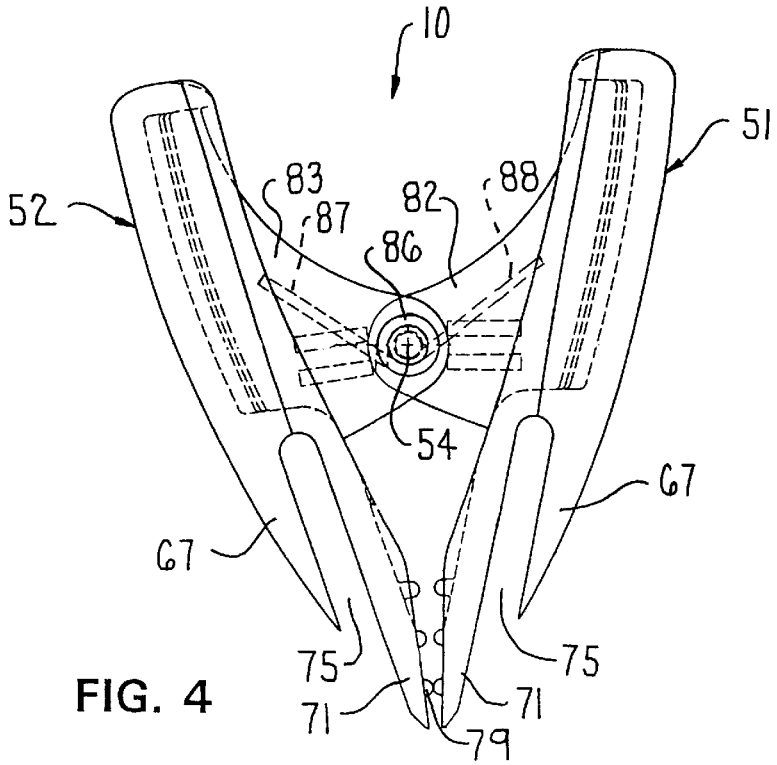
FIG. 4 is an end elevational view of the grip clip.

The clip 10 as illustrated in FIGS. 3–4 is defined by a pair of elongate arms or lever members 51 and 52 which herein are referred to as grip parts, the latter being centrally pivotally coupled together by a transversely extending hinge pin 53 which defines a hinge axis 54.

The grip parts 51 and 52 are disposed in generally opposed relationship and possess substantially identical structures, whereby the grip part 51 will be described, and it will be understood that the grip part 52 has the same construction.

The grip part 51 as illustrated by FIGS. 5–8 includes a main enlarged outer wall part 56 which has a top edge 57 joined between a pair of side edges 58, the latter in the illustrated embodiment being close to a parallel relationship, but being of a somewhat converging relationship as they project downwardly. The side edges 58 in turn join to opposite ends of a bottom edge 59, the latter having a smoothly rounded convex configuration which is substantially symmetrical about a central vertical plane 69 which perpendicularly vertically intersects the main wall part. The outer surface 61 of this main wall part 56 also preferably has a somewhat rounded or shallow convex curvature.

Figure 7:
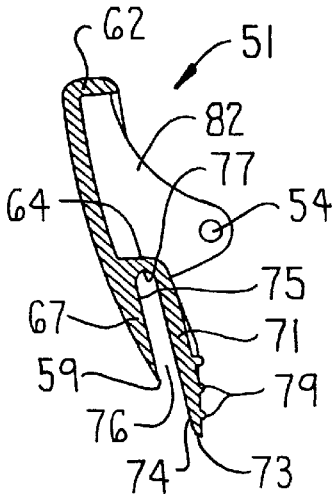
FIG. 7 is a sectional view of the grip part as taken along line 7—7 in FIG. 5.
Figure 8:
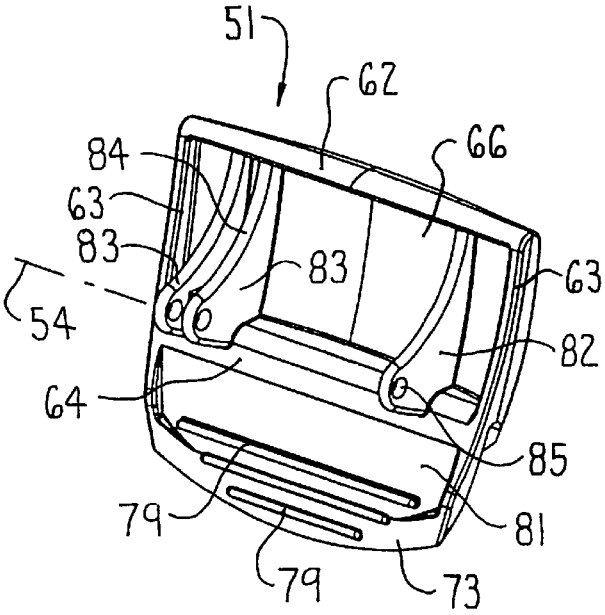
FIG. 8 is a perspective view showing the rear or inner side of the grip part shown in FIGS. 5–7.

A top flange 62 and side flanges 63 extend lengthwise along the top edge 57 and side edges 58, respectively, and project generally transversely inwardly from the outer surface 61 through a small distance. The side flanges 63 at their lower ends terminate at a bottom flange or rib 64 which projects rearwardly from the main wall part and extends transversely thereacross in generally parallel relationship to the top flange 62. This bottom flange 64, as illustrated by FIG. 7, is disposed downwardly a slight distance below the hinge axis 54. The flanges 62, 63 and 64 effectively define a rectangular wall which, in conjunction with the main wall part, define a shallow rearwardly opening recess or compartment 66.

The main outer wall part 56 also includes a tongue part 67 which substantially forms an extension of the main wall part and which projects downwardly in cantilevered fashion below the bottom flange or rib 64 so as to substantially terminate at the curved bottom edge 59. The bottom flange or rib 64 is disposed so as to extend across the main wall part at a location which is closely adjacent the corners where the curved bottom edge 59 intersects the side edges 58.

The grip part 51 also includes a jaw part 71 which at its upper edge is fixedly joined to the support rib 64 along the outer edge thereof so that the jaw part 71 extends substantially along the entire length of the rib. This jaw part 71 is cantilevered downwardly in spaced but generally parallel relationship to the tongue part 67.

Figure 5:
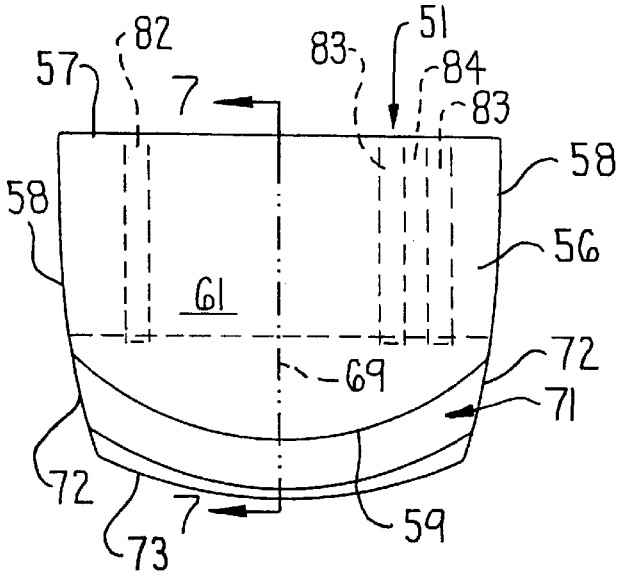
FIG. 5 is a front view showing the outer side of one of the pair of jaw parts which define the grip clip.

The jaw part 71 has side edges 72 which extend downwardly from adjacent opposite ends of the rib 64, with the side edges somewhat converging together as they project downwardly. These side edges 72 effectively define a continuation of the side edges 58 associated with the main wall part 56 so as to define a substantially continuous side edge when viewed from the front as illustrated by FIG. 5. The jaw part 71 terminates in a bottom edge 73 which is of a smoothly rounded or convex curvature and which is also centered relative to the central transverse plane 69. Opposite ends of this curved bottom edge 73 join to the side edges 72.

The jaw part 71 defines thereon an enlarged front surface 74 which is spaced rearwardly from the outer surface 61 of the main wall part 56. This front surface 74 is also spaced rearwardly from an opposed and generally parallel rear surface 75 defined on the tongue part 67, which spaced but opposed surfaces 74 and 75 define a slot 76 therebetween of substantially uniform but narrow width. The slot 76 opens upwardly from the free end of the tongue part 67 and, at the upper end thereof, is terminated by a rounded end wall 77 as defined on the bottom flange 64. The upper edge or extremity of the slot 76, as defined by the end wall 77, extends across the entire width of the grip part so that the slot 76 thus opens lengthwise across the entire width of the clip.

Figure 6:
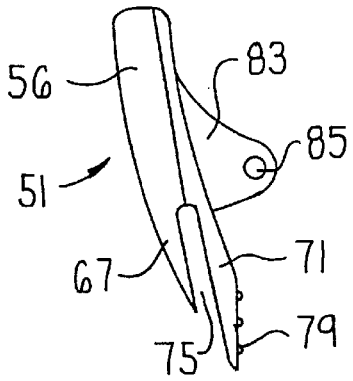
FIG. 6 is an end view of the grip part illustrated in FIG. 5.

As illustrated by FIGS. 5–7, the jaw part 71 is cantilevered downwardly through a significantly greater distance than the tongue part 67, whereby the curved bottom edge 59 of the tongue part 67 is thus spaced upwardly relative to the curved bottom edge 73 of the jaw part, thereby facilitating access to the slot 76 when mounting of the clip 10 on the support rail 18 is desired, as explained hereinafter.

The jaw part 71 on the inner or rear surface thereof adjacent the lower free end, is provided with one or more gripping ribs 79 (three gripping ribs in the illustrated embodiment) protruding outwardly for gripping engagement with a document. The gripping ribs 79 in the illustrated embodiment comprise a series of elongate ribs which extend widthwise of the inner surface of the jaw part, with the individual ribs being disposed in generally parallel but spaced relationship in a direction away from the tip end of the jaw part. This jaw part 71 also defines a shallow recess 81 on the rear or inner side thereof, which recess extends generally between the bottom flange 64 and the uppermost gripping rib 79.

To permit the opposed grip parts 51 and 52 to be hingedly joined in opposed relation, the grip part 51 has a first hinge plate 82 fixed to the rear side of the main wall part 56 and projecting generally perpendicularly rearwardly therefrom in generally parallel relationship to the central transverse plane 69. This hinge plate 82 is disposed inwardly a small distance from one of the side edges 58, and is anchored not only to the main wall part but also extends across the shallow recess or compartment 66 for connection to the top and bottom flanges 62 and 64.

Another hinge plate 83, and in the preferred embodiment an adjacent pair of hinge plates 83, are fixedly secured to and project transversely from the main wall part in the vicinity of the other side edge 58. The hinge plates 83 are shaped and are fixedly secured to the main wall part in the same manner described above relative to the hinge plate 82. The hinge plates 83 are disposed in parallel but sidewardly spaced relation to define a narrow slot 84 therebetween, which slot only slightly exceeds the width of the hinge plate 82, and the centerline of this slot 84 is spaced from its adjacent side edge 58 by the same spacing distance between the centerline of the hinge plate 82 and its respective side edge 58. The hinge plates 82 and 83, adjacent the outer ends thereof, have aligned openings 85 therethrough which define the hinge axis 54 for the hinge pin 53. This hinge axis 54 extends in the transverse or widthwise direction of the clip and is substantially parallel to the elongated direction of the gripping ribs 79.

In the illustrated and preferred embodiment, the grip parts 51 and 52 are identical, preferably being molded, such as injection molded, of a plastic material. Suitable plastic materials for this purpose are, for example, ABS, PP, and HDPE.

To assemble the grip clip 10 the identical grip parts 51 and 52 are disposed so that the inner sides thereof are disposed in adjacent and opposed relationship. The two grip parts are then moved inwardly toward one another so that the hinge plate 82 on each grip part slides into the slot 84 defined between the pair of hinge plates 83 on the opposed grip part. When all of the openings 85 in the overlapping hinge plates 82 and 83 are aligned, then the hinge pin 53 is inserted through the aligned openings to hingedly couple the grip parts 51 and 52 together. One end of the hinge pin 53 is preferably provided with an enlarge head thereon and, after insertion and seating of the hinge pin, then the other end of the hinge pin is suitably deformed or upset so as to secure the hinge pin and prevent separation of the grip parts.

The grip parts 51 and 52 are rotatably urged about the hinge pin into a closed position wherein the opposed jaw parts 71 either engage one another as shown in FIG. 4 or engage a document therebetween. For this purpose, the grip clip 10 is provided with a spring or biasing structure which continuously urges the clip into the closed or gripping position. In the illustrated embodiment this is accomplished by a torsion spring 86 which surrounds an intermediate portion of the hinge pin 53, and the legs 87 and 88 of the spring project outwardly for engagement with the inner or rear surfaces of the grip parts so as to continuously urge the grip parts toward the closed or gripping position (FIG. 4).

To use the grip clip, it can be readily gripped in one hand by engaging the top of the clip, specifically the upper portions of the main wall parts 56. For example, the fingers can grip the upper portion of the main wall part of the right grip part 51 and the thumb can be utilized to grip the upper portion of the main wall part of the other grip part 52. The hand can then be closed so as to move the upper portions of the main wall parts toward one another, thereby swinging the jaw parts 71 away from one another into a separated or open position. The worker can then, using the other hand, easily insert a paper or document into the opening between the gripping jaws 71, following which the grip clip is allowed to close due to the urging of the spring 86 so as to grip an edge portion of the document between the jaw parts. The gripping is facilitated by the gripping ribs or projections 79 associated with the inner jaw surfaces. Release of the document from the gripping clip is accomplished by substantially reversing the above operation.

The grip clip 10 can also be desirably supported on the support rail 16, both when not in use, and when used to support a document. To position the grip clip 10 on the rail 16, the grip clip 10 is manually gripped from above and moved toward the rail until the free end of the tongue part 67 is aligned with the mouth 25 of the front rail slot 34. In this position, the portion of the front surface of the jaw part 71 as disposed below the tongue part 67 can be substantially abutted against the outer surface of the front or top rail wall 31 to facilitate positioning and alignment of the grip clip with the rail slot. Thereafter the grip clip is slidably moved downwardly so as to cause the tongue part 67 to slidably project into the rail slot 34. This continues until the front rail wall 31 is fully inserted into the clip slot 76 and substantially abuts the end wall 77 thereof. The tongue part 67 is of progressive increasing thickness as it projects away from the lower free edge so as to permit a reasonably snug but slidable mounting of the clip 10 on the rail 16.

Figure 9:
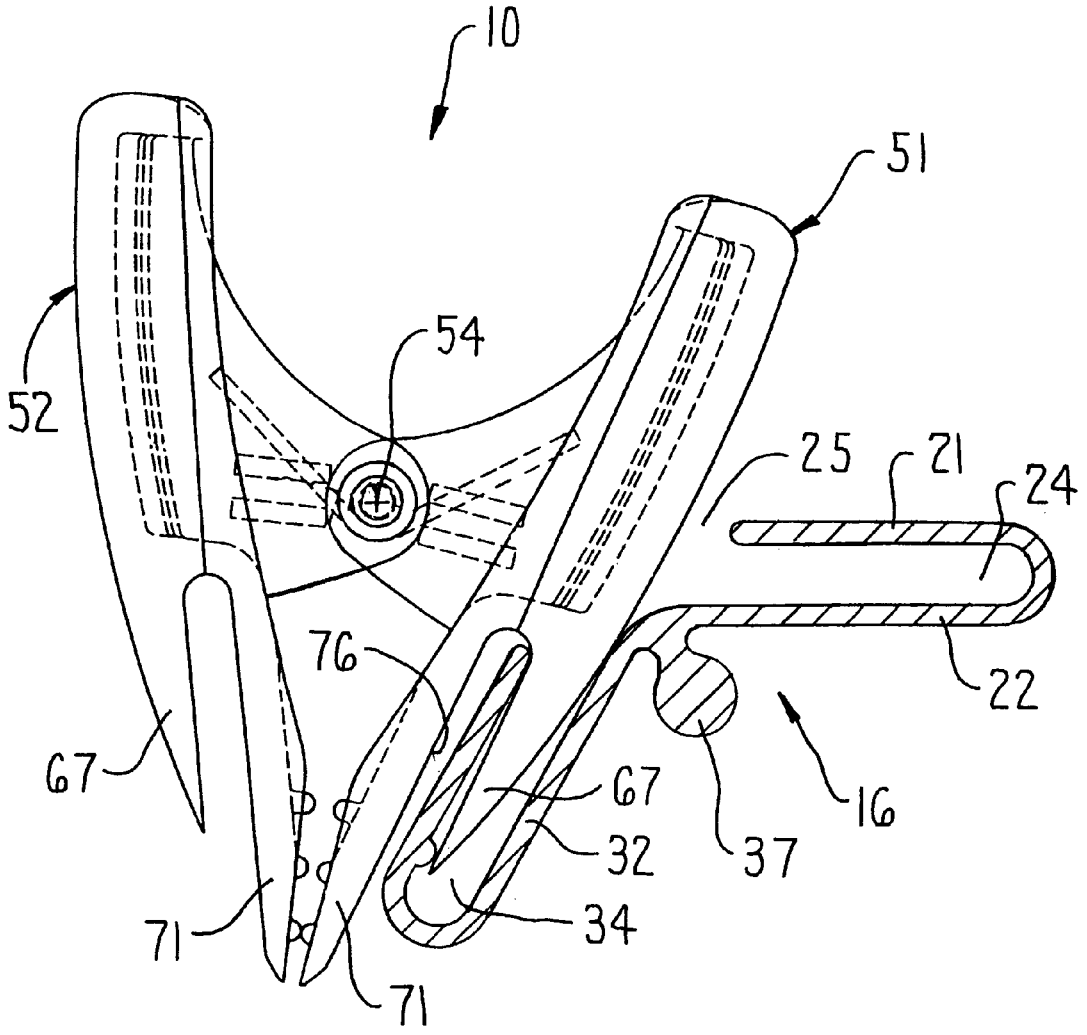
FIG. 9 is a side elevational view that shows the rail having the grip clip mounted thereon.

With the clip 10 mounted on the rail 16, substantially as illustrated in FIG. 9, the clip can be supported either with or without a document engaged therein. If a document is engaged therein, then the document is positioned so as to be suspended downwardly adjacent the rear of the worksurface but above the top thereof, and thus can be readily accessed both visually and physically by a worker utilizing the worksurface. The clip 10 can also be readily slidably moved longitudinally along the rail to any desired position. When not in use, the clip can also be slidably inserted into the top rail slot 24 for storage purposes if desired.

With the clip 10 mounted on the rail, the clip can still be manually opened and closed so as to insert or remove documents therefrom in the same manner described above, without requiring removal of the clip from the rail.

When portability of several documents is required, the clip can be removed from the rail and used for gripping several documents together, and in fact can even be used for gripping several documents to a support board so as to function similar to a clip board, thereby providing flexibility and portability.

Due to the identity of the clip parts 51 and 52, the right and left sides of the clip are identical in that they are mirror images about the central transverse plane 69 and the front and rear sides of the clip are also identical. Thus, mounting the clip on the rail is thus greatly facilitated since the identity of the opposite sides of the clip thus enables the clip to be mounted on the rail by engaging either grip part 51 or 52 with the rail due to the provision of the identical tongue part 67 and cooperating slot 76 on each of the grip parts. The user hence does not have to be concerned about proper orientation of the clip.

The support rail arrangement 16, in place of being mounted directly on the worksurface, can be stationarily mounted using other structures, such as arms which secure to an adjacent wall and project outwardly for securement to the support rail, as described in aforementioned copending Ser. No. 09/304,162.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A grip clip for engaging a document, said clip comprising:

a pair of identical, one-piece, monolithic elongate elements each constructed of a rigid plastic material, said elongate elements being disposed in adjacent and opposed relationship and pivotally joined together by a hinge structure which is disposed between the opposed elongate elements and substantially centrally between opposite ends thereof for defining a hinge axis which extends transversely of the elongate elements, a spring cooperating with the elongate elements for relatively urging the elongate elements in opposite directions about the hinge axis into a closed gripping position, said pair of elongate elements defining thereon integral first elongate arm portions which are disposed in spaced relation from one another on opposite sides of the hinge axis and are cantilevered upwardly therefrom, said pair of elongate elements also including integral second elongate arm portions which are disposed at opposite sides of the hinge axis and are cantilevered downwardly therefrom, said second arm portions adjacent free ends thereof having opposed inner gripping surfaces which are directly engageable with one another or a document disposed therebetween when the clip is in the closed position, the second arm portions of said elongate elements each having a forked construction when viewed in a plane perpendicular to the hinge axis and including inner and outer arms which are cantilevered downwardly and separated by a narrow slot which extends upwardly between the inner and outer arms and terminates at a closed upper end which is spaced downwardly a substantial distance from an upper free end of the respective elongate element, each said inner arm defining thereon a respective said gripping surface and being cantilevered downwardly through a greater extent than the respective outer arm, each said inner arm also defining thereon an outwardly facing surface which projects downwardly below a mouth of the respective slot to facilitate insertion of a support wall thereinto, and each said outer arm having a progressively increasing thickness defined in a direction transverse to the hinge axis as said outer arms project away from respective free ends thereof.

2. A clip according to claim 1, wherein said second arm portions are substantially aligned with and constitute extensions of the respective said first arm portions.

3. A clip according to claim 2, wherein, when the clip is in the closed position, the first arm portions diverge with respect to one another as the first arm portions project upwardly relative to the hinge axis.

4. A clip according to claim 1, wherein each of the elongate elements includes a pair of bearing support plates which project transversely inwardly from an inner side thereof toward the opposed elongate element, whereby the bearing support plates on the opposed elongate elements overlap, and the hinge structure includes a hinge pin which projects through aligned openings formed in the overlapping bearing plates.

5. A clip according to claim 1 wherein said outer arms each define an inwardly facing surface disposed in opposed relation with said outwardly facing surface of the respective said inner arm, each said slot having a width defined transversely between said surfaces of said inner and outer arms which is substantially uniform.

6. An office accessory arrangement, comprising in combination:

a stationary support rail having a channel member which defines an outwardly opening narrow slot;

a grip clip for holding a document, said grip clip being removably supported on said rail;

said grip clip including a pair of identical, one-piece, monolithic grip members constructed of a rigid plastic material, said grip members being disposed in opposed relation with one another and being centrally joined by a hinge arrangement which defines a hinge axis for enabling relative pivoting of said grip members about said hinge axis;

said grip members respectively including first elongate portions which project in one direction away from said axis and are disposed so as to be manually engaged, said grip members respectively including second elongate portions which project in an opposite direction from the hinge axis;

said grip clip having a biasing structure which relatively pivotally biases the grip members in opposite directions toward a closed position;

each said second elongate portion defining inner and outer cantilevered arm parts disposed in spaced relation with one another to define a slot therebetween which opens inwardly from a position adjacent one end of the respective second elongate portion and projects along the second elongate portion generally parallel with the axis and terminates at a closed end which is disposed a substantial distance from the other end of the respective grip member, said inner arm parts defining respective opposed inner gripping surfaces adjacent free ends thereof which are engageable with one another or a document disposed therebetween when the grip clip is in the closed position; and said channel member of said support rail having a cantilevered wall defining one side of the slot in the support rail, one of said outer arm parts of said grip clip being insertable into the rail slot for confinement therein simultaneous with insertion of the cantilevered wall of said rail into the respective slot of the grip clip, each said outer arm part having a progressively increasing thickness defined in a direction transverse to the hinge axis as said outer arm part projects away from a free end thereof toward the hinge axis, and said thickness of said outer arm part adjacent said closed end of said clip slot is similar to a width dimension of said rail slot to provide a substantially snug mounting of said grip clip on said rail.

7. An arrangement according to claim 6, wherein said inner arm part has a cantilevered length which is greater than the cantilevered length of said outer arm part so as to project beyond a free end of the cantilevered outer arm part to assist in insertion of said cantilevered wall into the clip slot.

8. An arrangement according to claim 6, wherein said support rail is elongated and said slot thereof extends along the elongated direction of the support rail and opens transversely relative to said elongated direction for permitting engagement or disengagement of the clip relative to the rail due to moving of the clip in said transverse direction, said clip being slidable along the rail in said elongated direction.

9. An arrangement according to claim 8, wherein the rail is elongated horizontally and the slot thereof opens generally upwardly.

10. An arrangement according to claim 9 including an upright support arm attachable to a work surface so as to project upwardly a significant distance thereabove, said support arm mounting the support rail on an upper end thereof.

11. An arrangement according to claim 6 wherein each said inner arm part projects beyond the respective said outer arm part and defines thereon an outwardly facing surface which projects beyond a mouth of the respective said clip slot to facilitate insertion of said cantilevered wall of said support rail therein.

12. An arrangement according to claim 6 wherein said outer arm parts are rigid and inflexible.

* * * * *